US009409413B2

(12) United States Patent
Kaneko et al.

(10) Patent No.: US 9,409,413 B2
(45) Date of Patent: Aug. 9, 2016

(54) RECORDING APPARATUS AND RECORDING METHOD FOR IMPROVING THE CLARITY OF AN IMAGE

(71) Applicant: CANON KABUSHIKI KAISHA, Tokyo (JP)

(72) Inventors: Takumi Kaneko, Tokyo (JP); Rie Takekoshi, Kawasaki (JP); Kazuki Narumi, Komae (JP); Ayumi Hirakawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/252,642

(22) Filed: Apr. 14, 2014

(65) Prior Publication Data

US 2014/0307017 A1 Oct. 16, 2014

(30) Foreign Application Priority Data

Apr. 16, 2013 (JP) ..... 2013-086144

(51) Int. Cl.
*B41J 2/21* (2006.01)

(52) U.S. Cl.
CPC ..... *B41J 2/2125* (2013.01); *B41J 2/2107* (2013.01)

(58) Field of Classification Search
CPC ..... B41J 2/2107; B41J 2/2125; B41J 2/2121
USPC ..... 347/105, 100, 43, 12, 15
See application file for complete search history.

(56) References Cited

U.S. PATENT DOCUMENTS

| | | | | |
|---|---|---|---|---|
| 5,328,748 | A * | 7/1994 | Westfal | B41M 5/52 347/105 |
| 6,123,411 | A * | 9/2000 | Inui | B41J 2/195 347/100 |
| 6,517,191 | B1 * | 2/2003 | Koitabashi | B41J 2/2114 347/100 |
| 6,540,329 | B1 * | 4/2003 | Kaneko | C09D 11/40 347/100 |
| 8,356,871 | B2 * | 1/2013 | Kunimine | B41J 2/2114 347/12 |
| 2003/0151642 | A1 * | 8/2003 | Kaneko | B41J 2/2107 347/43 |

FOREIGN PATENT DOCUMENTS

JP 2008-162095 A 7/2008

* cited by examiner

*Primary Examiner* — Julian Huffman
*Assistant Examiner* — Michael Konczal
(74) *Attorney, Agent, or Firm* — Canon U.S.A., Inc. IP Division

(57) ABSTRACT

In a recording apparatus, a dot diameter of a first color ink formed by discharging a predetermined amount of the first color ink onto a surface of a second color ink fixed on a recording medium is smaller than a dot diameter of the second color ink formed by discharging the predetermined amount of the second color ink onto a surface of the first color ink fixed on the recording medium, and a recording head discharges the plurality of inks such that with respect to pixels forming an image in a unit area, pixels formed by discharging the second color ink and the first color ink in this order are greater than pixels formed by discharging the first color ink and the second color ink in this order.

19 Claims, 14 Drawing Sheets

FIG. 6A1
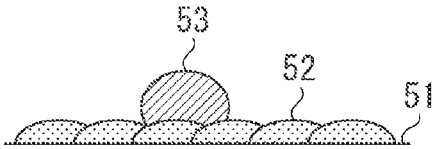
FIG. 6B1
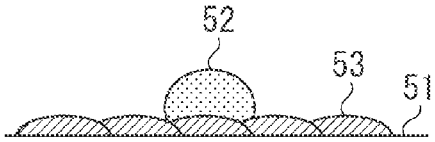
FIG. 6A2
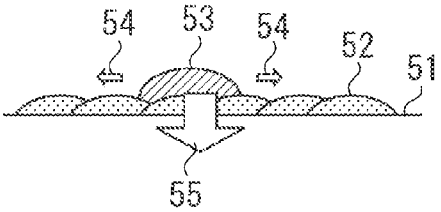
FIG. 6B2
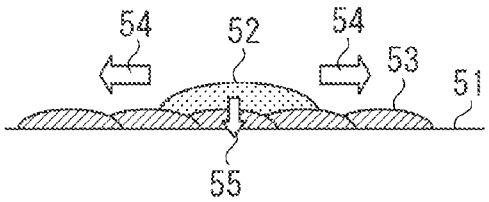
FIG. 6A3
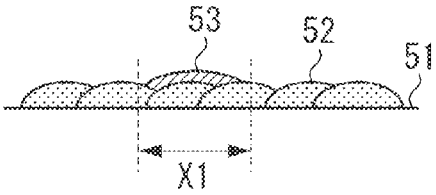
FIG. 6B3
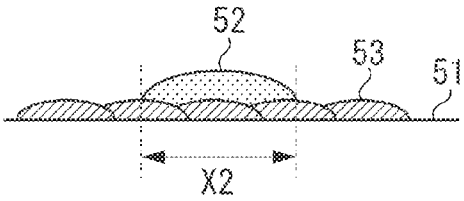

RECORDING APPARATUS AND RECORDING METHOD FOR IMPROVING THE CLARITY OF AN IMAGE

BACKGROUND OF THE INVENTION

1. Field of the Invention

The present invention relates to a recording apparatus and a recording method.

2. Description of the Related Art

It is conventionally known that an inkjet recording apparatus has various advantages such as ability to record a high-quality image at high speed, low running costs, and ability to perform quiet recording. Many inkjet recording apparatuses record an image using inks containing pigments. An inkjet recording apparatus using pigment inks is used also to record images for a poster and a photograph, and has been required to record a higher-quality image in recent years.

When recording of the images is performed using pigment inks, there is a known problem in the image clarity of the recorded material. The image clarity is an indicator for determining whether or not a recorded image appears vividly when light has been projected onto the recorded image. The image clarity is known as one indicator for evaluating glossiness. It is known that the smoother the image obtained on the surface of a recording medium, the higher the image clarity, and that the more uneven the image, the lower the image clarity. Pigment inks are fixed while depositing on the surface of a recording medium in a laminated manner, whereas dye inks are fixed while penetrating into a recording medium. Thus, pigment inks are more likely to increase the unevenness of the surface of an image than dye inks, and therefore it is difficult to obtain a high image clarity. The image clarity can be measured according to a method described in JIS-K7105.

To reduce the deterioration of the glossiness resulting from the deterioration of the image clarity due to the use of pigment inks, Japanese Patent Application Laid-Open No. 2008-162095 discusses a method of acquiring the gloss characteristic value of an image to be recorded from the gloss characteristic value specific to each pigment ink. According to the method, inks that cause the deterioration of the glossiness are combined, the degree of dot dispersion is reduced and the dots are joined to record an image. The joined dots form a single large dot on a recording medium. The surface of the large dot is smoother than the surface formed when the same number of dots as the joined dots are imparted in different recording scans. This can reduce the deterioration of the image clarity.

The method discussed in the Japanese Patent Application Laid-Open No. 2008-162095, however, performs recording by forming a large dot, and therefore results in forming an image having a granular quality.

Further, as a result of studies, the inventors have found that by the method discussed in the Japanese Patent Application Laid-Open No. 2008-162095, the gloss characteristic value of an image is determined based on the gloss characteristics of each ink to be used, and therefore a sufficient image clarity may not be in some cases obtained.

This problem is described in detail below.

FIGS. 1A, 1B, and 1C are cross-sectional views of the state of the surface of a recording medium when a first ink has been applied and fixed on the recording medium, and then a second ink different from the first ink is applied.

The first and second inks have the relationship such that the second ink penetrating into the layer of the first ink fixed on the medium has a smaller permeability than a permeability of the first ink penetrating into the layer of the second ink fixed on the medium. Largeness of the permeability varies depending on various factors, but is largely controlled particularly by the physicochemical properties of the first ink applied under the second ink. In the specification, the power of an ink applied underneath that inhibits the penetration of an ink applied above is referred to as the penetration inhibiting power of the ink applied underneath.

FIG. 1A illustrates the state of dots 1102, which are formed after the first ink has been applied onto a recording medium 1101 and fixed. The first ink produces a color owing to a pigment 1103 (a color material component) which has become deposited on the recording medium 1101. Further, the dots 1102 of the fixed first ink contain not only the pigment 1103 but also a resin component and a solvent component, although in small amounts.

FIG. 1B illustrates the state of a dot 1106, which is formed by the second ink immediately after the second ink has been applied on top of the dots 1102 of the first ink in a laminated manner. If the permeability of the second ink penetrating into the first ink is small, it is difficult for a solvent component contained in the second ink, such as moisture and solvent, to penetrate into the dots 1102 of the first ink. Accordingly, the solvent component that cannot penetrate into the dots has a strong tendency to spread in directions parallel to the surface of the recording medium 1101.

FIG. 1C illustrates the state of the dot 1106 of the second ink fixed on the dots 1102 of the first ink. The dot 1106 of the second ink is formed to spread more in directions parallel to the recording medium 1101, as compared to a state immediately after the application of the second ink as illustrated in FIG. 1B. Further, until the second ink has been fixed, the solvent component flows in directions parallel to the surface of the recording medium 1101. Thus, a pigment 1107 and a resin component are also influenced by the flow and tend to concentrate in an end portion 1110 of the dot 1106. As a result, in the obtained image, an area corresponding to the end portion 1110 of the dot 1106 of the second ink becomes more bulky than other areas.

FIGS. 2A to 2B are diagrams sequentially illustrating the state of the surface of a recording medium when first and second inks have been applied to the recording medium by four recording scans without setting a particular order of application of the first and second inks.

FIG. 2A illustrates the surface of the recording medium after a first recording scan. Specifically, a dot 603 of the first ink and a dot 602 of the second ink are formed on a recording medium 601. At this time, the recording duty is low, and therefore, individual dots are not in contact with each other and are fixed in isolation.

FIG. 2B illustrates the state after a second recording scan. At this time, areas appear where two dots overlap with each other. The first ink has a strong penetration inhibiting power, and therefore, the ink applied at a position overlapping with a dot 605 of the first ink formed by the first recording scan flows to the recording medium 601. This forms an ink dot 606 biased in the direction of the recording medium 601. Further, due to this flow of the ink, also a pigment and a resin component to be deposited on the surface of the recording medium 601 after fixing move in the direction of the recording medium 601. Thus, an end portion 604 of the dot 606 tends to become bulky. As described above, this phenomenon is caused mainly by the strength of the penetration inhibiting power of the ink applied underneath. Thus, regardless whether the first or second ink has been applied on top of the dot 605 of the first ink, this phenomenon occurs.

Thus, the more the areas in the recording medium where an ink is applied on top of a dot of the already fixed first ink, the more the bulky areas. The occurrence of such local bulkiness results in a low smoothness of the surface of an image to be ultimately obtained. Thus, a sufficient image clarity may not be obtained.

The above problem of the image clarity notably arises, particularly when recording is performed by using glossy paper. The glossy paper is a recording medium on the surface of which an absorbing layer for absorbing ink is formed.

SUMMARY OF THE INVENTION

The present invention is directed to providing a recording apparatus capable of reducing the granular quality, when an image is formed by using inks containing pigments, while reducing the deterioration of the image clarity resulting from the permeability of an ink applied above, that penetrates into an ink applied underneath.

According to an aspect of the present invention, a recording apparatus includes: a recording head configured to discharge a plurality of inks including a first color ink containing a pigment and a second color ink which contains a pigment and is different from the first color ink; and a recording control unit configured to, while scanning with the recording head in a scan direction relative to a recording medium, discharge the plurality of inks from the recording head to a unit area in the recording medium, thereby recording an image, wherein a dot diameter of the first color ink formed by discharging a predetermined amount of the first color ink onto a surface of the second color ink fixed on the recording medium is smaller than a dot diameter of the second color ink formed by discharging the predetermined amount of the second color ink onto a surface of the first color ink fixed on the recording medium, and wherein the recording head discharges the plurality of inks such that with respect to pixels forming an image in the unit area, pixels formed by discharging the second color ink and then the first color ink in this order are greater than pixels formed by discharging the first color ink and then the second color ink in this order.

Further features of the present invention will become apparent from the following description of exemplary embodiments with reference to the attached drawings.

BRIEF DESCRIPTION OF THE DRAWINGS

FIGS. 6A1 to 6B3 are diagrams illustrating the correlation between a penetration inhibiting power and a dot diameter.

DESCRIPTION OF THE EMBODIMENTS

Various exemplary embodiments, features, and aspects of the invention will be described in detail below with reference to the drawings.

With reference to the drawings, a first exemplary embodiment of the present invention is described in detail below.

Figure 3:
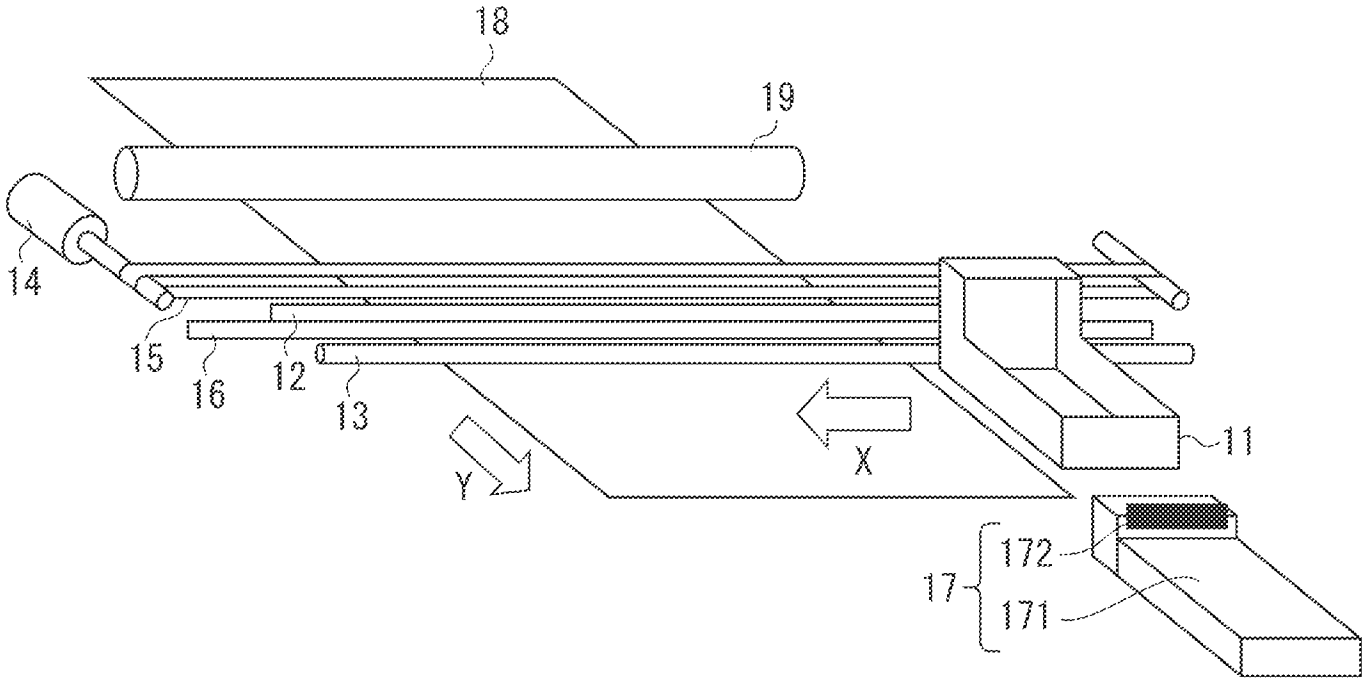
FIG. 3 is a perspective view of a recording apparatus applied to an exemplary embodiment.

FIG. 3 is a perspective view partially illustrating the internal structure of a recording apparatus according to the present exemplary embodiment.

On a carriage 11, a recording head (not illustrated) is mounted. In the carriage 11, a connector holder is provided, which is an electric connection unit for transmitting a driving signal to the recording head. The driving signal is transmitted from a recording control unit via a flexible cable 12. The carriage 11 is supported to move back and forth along a guide shaft 13. The guide shaft 13 is placed in the body of the apparatus to extend in an X-direction, which is a recording scanning direction. Then, the carriage 11 moves back and forth driven by a carriage motor 14 through a drive mechanism such as a timing belt 15 The position and the movement of the carriage 11 are controlled using an encoder sensor 16, which optically reads the position of the carriage 11.

The carriage 11 moves a distance exceeding the width of a recording medium 18 in the X-direction. In an end portion of the area where the carriage 11 moves, a restoration unit 17 for performing maintenance of the recording head is provided. The restoration unit 17 includes: a cap 171 for protecting a discharge port surface of the recording head when the recording head performs suction or is left as it is; and a wiper blade 172 for wiping the discharge port surface of the recording head.

A conveyance roller 19 is in contact with the recording medium 18. The conveyance roller 19 is driven to convey the recording medium 18 from upstream to downstream in a Y-direction, which is a conveying direction.

The recording head used in the present exemplary embodiment includes an electrothermal converter for generating thermal energy, and discharges inks from discharge ports using film boiling caused by the thermal energy applied by the electrothermal converter to perform recording. It goes without saying that in the present invention, the recording head may be of a different type, for example, a recording head that discharges inks using a piezoelectric element.

Figure 4:
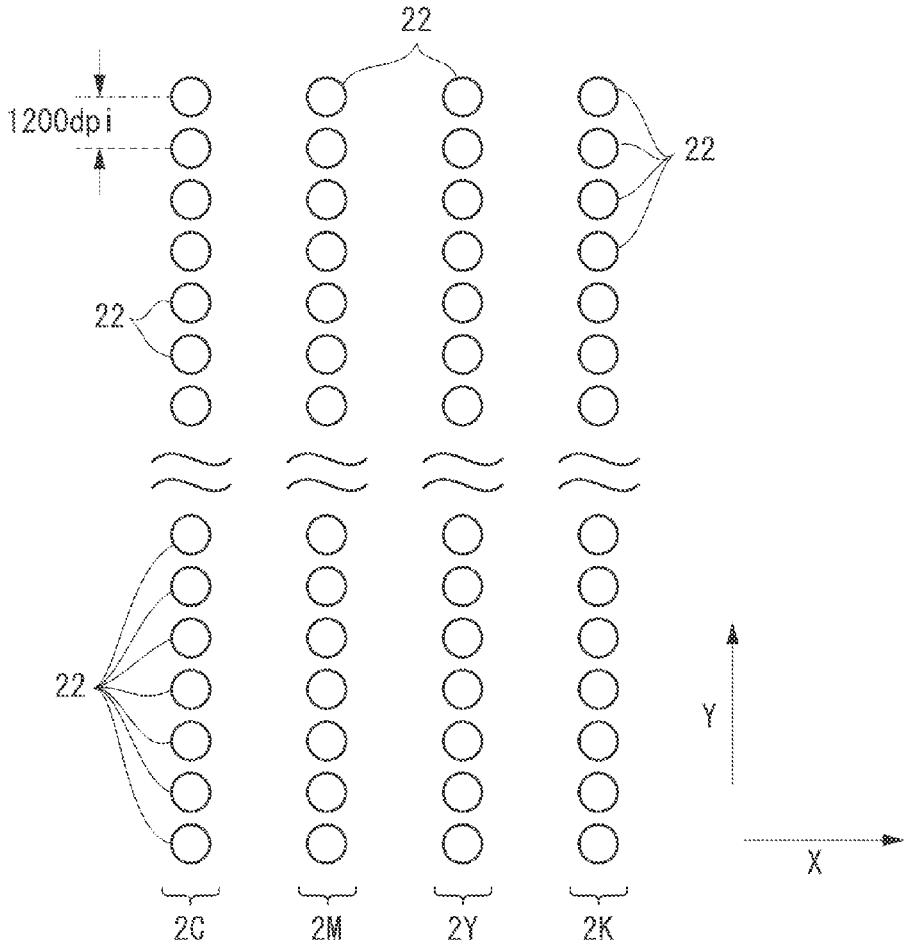
FIG. 4 is a schematic diagram of a recording head applied to the exemplary embodiment.

FIG. 4 is a schematic diagram illustrating the discharge port side of a recording head 21 used in the present exemplary embodiment. The recording head 21 according to the present exemplary embodiment includes for each ink a discharge port array in which 1280 discharge ports are arranged in the Y-direction (an arrangement direction) with a density of 1200 ports per inch (1200 dpi). A discharge port array 2C for discharging a cyan ink, a discharge port array 2M for discharging a magenta ink, a discharge port array 2Y for discharging a yellow ink, and a discharge port array 2K for discharging a black ink are arranged in parallel with each other in the X-direction of the recording head 21.

The amount of ink discharged from each discharge port 22 is about 4.5 pl. The amount of discharge of the black ink, however, may be set to be slightly greater than the other inks in order to achieve a high concentration. The recording apparatus according to the present exemplary embodiment causes such a recording head to scan in the X-direction, while causing the recording head to discharge inks, so that the recording apparatus can record dots with a recording duty of 2400 dpi in the X-direction and 1200 dpi in the Y-direction. Further, in the recording head 21 used in the present exemplary embodiment, which discharges color inks of four colors in total, four discharge port arrays for discharging inks of four colors in total are integrated together. Alternatively, the present exemplary embodiment may use a configuration in which four recording heads including discharge port arrays for discharging inks of the respective colors are independently formed and are arranged in the X-direction.

By using the recording head 21, normally, recording is performed by repeating a recording operation for moving the carriage 11 in the X-direction, while discharging inks from the recording head 21, and a conveying operation for conveying the recording medium 18 by a predetermined amount in the Y-direction.

(Exemplary Configuration of Image Processing System)

Next, a configuration for controlling the recording of an inkjet recording apparatus is described.

Figure 5:
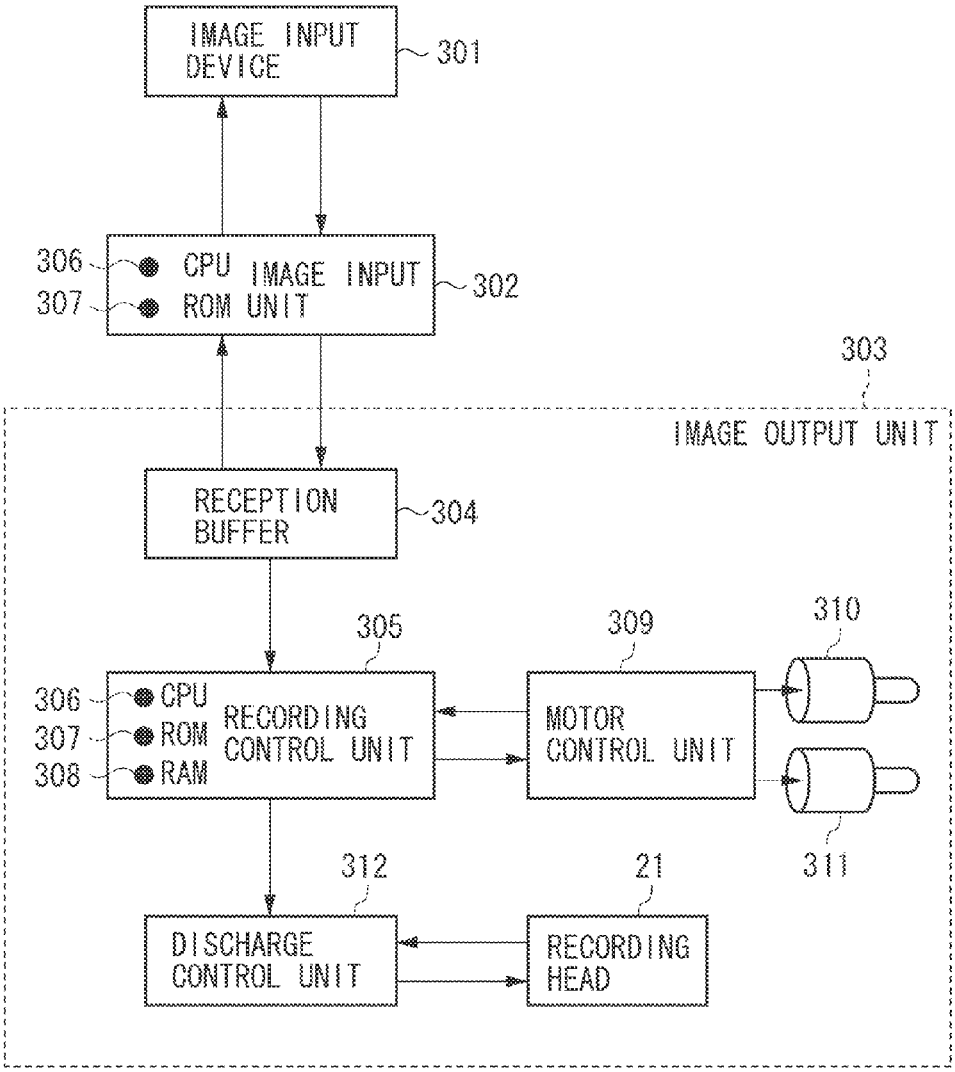
FIG. 5 is a block diagram illustrating the configuration of a recording control system according to the exemplary embodiment.

FIG. 5 is a block diagram illustrating the general configuration of a recording control system according to the present exemplary embodiment.

Multi-valued image data saved in an image input device 301 such as a scanner, a digital camera, or various storage media is input to an image input unit 302. The image input unit 302 is a host computer connected externally outside the recording apparatus. The image input unit 302 includes: a central processing unit (CPU) 306, which is required to transfer image data; and a read-only memory (ROM) 307, which stores mask patterns as described below. The image input unit 302 transfers image information to be recorded to an image output unit 303, which is the recording apparatus.

A reception buffer 304 is an area for temporarily storing data transferred from the image input unit 302, and stores the received data until a recording control unit 305 reads the data.

The recording control unit 305 includes: a CPU 306; a ROM 307, in which a control program is stored; and a random-access memory (RAM) 308, which serves as a work area when various types of image processing are performed. The recording control unit 305 performs image processing on multi-valued input image data read from the reception buffer 304, thereby converting the multi-valued input image data into binary image data indicating the presence or absence of a dot. Further, the recording control unit 305 also controls, through a motor control unit 309, a carriage motor 310 for scanning the recording head 21 in the X-direction, and a conveyance motor 311 for conveying the recording medium 18 in the Y-direction. Based on the binary image data converted by the recording control unit 305, a discharge control unit 312 applies mask patterns stored in the ROM 307 to the processing, thereby controlling the operation of the recording head 21, and applies inks to the recording medium 18, thereby recording an image.

Next, a description is given of examples of the ingredients of an ink set and a preparation method that are applied in the present exemplary embodiment. In the present exemplary embodiment, pigment inks of four colors containing pigments are used as colored inks.

<Black Ink>

(1) Preparation of Dispersion Liquid

An anionic polymer P-1 [styrene-butylacrylate-acrylic acid copolymer (a copolymerization ratio of 30/40/30, an acid value of 202, a weight-average molecular mass of 6500)] was neutralized with a potassium hydroxide solution and diluted with ion-exchanged water, thereby preparing 10 mass percent of a homogeneous polymer solution.

The above polymer solution (600 g), carbon black (100 g), and ion-exchanged water (300 g) were mixed and mechanically agitated for a predetermined time. Then, the mixture was subjected to a centrifugal process, thereby removing undispersed material including coarse particles to obtain a black dispersion liquid. The obtained black dispersion liquid had a pigment concentration of 10 mass percent.

(2) Preparation of Resin Solution

In 15.0 mass percent of a resin composed of styrene and acrylic acid, one equivalent weight of potassium hydroxide was added to a carboxylic acid constituting the acrylic acid, and the remaining part was adjusted with water to 100.0 mass percent. Then, the resulting product was agitated at 80° C. to dissolve the resin. Then, the resulting product was adjusted with water to have a solid content of 15.0 mass percent to obtain a resin solution. The resin had a weight-average molecular mass of 7000.

(3) Preparation of Ink

The following ingredients were added to the above black dispersion liquid to obtain a predetermined concentration. Then, these ingredients were sufficiently mixed and agitated, and thereafter, the mixture was filtered under pressure through a microfilter (manufactured by Fujifilm Corporation) having a pore size of 2.5 μm, thereby preparing a pigment ink having a pigment concentration of 3 mass percent.

| | |
|---|---|
| The above black dispersion liquid | 30 parts |
| The above resin solution | 6 parts |
| Glycerin | 10 parts |
| Triethylene glycol | 10 parts |
| Acetylene glycol ethylene oxide (EO) adduct (manufactured by Kawaken Fine Chemicals Co., Ltd.) | 0.5 parts |
| Ion-exchanged water | 43.5 parts |

<Yellow Ink>

(1) Preparation of Dispersion Liquid

The anionic polymer P-1 was neutralized with a potassium hydroxide solution and diluted with ion-exchanged water, thereby preparing 10 mass percent of a homogeneous polymer solution.

The above polymer solution (600 g), Color Index (C.I.) Pigment Yellow 74 (100 g), and ion-exchanged water (300 g) were mixed and mechanically agitated for a predetermined time. Then, the mixture was subjected to a centrifugal process, thereby removing undispersed material including coarse particles to obtain a yellow dispersion liquid. The obtained yellow dispersion liquid had a pigment concentration of 10 mass percent.

(2) Preparation of Resin Solution

In 15.0 mass percent of a resin including styrene and acrylic acid, one equivalent weight of potassium hydroxide was added to a carboxylic acid constituting the acrylic acid, and the remaining part was adjusted with water to 100.0 mass percent. Then, the resulting product was agitated at 80° C. to dissolve the resin. Then, the resulting product was adjusted with water to have a solid content of 15.0 mass percent to obtain a resin solution. The resin had a weight-average molecular mass of 7000.

(3) Preparation of Ink

The following ingredients were added to the above yellow dispersion liquid to obtain a predetermined concentration. Then, these ingredients were sufficiently mixed and agitated, and thereafter, the mixture was filtered under pressure through a microfilter (manufactured by Fujifilm Corporation) having a pore size of 1.0 μm, thereby preparing a pigment ink having a pigment concentration of 4 mass percent.

| | |
|---|---|
| The above yellow dispersion liquid | 40 parts |
| The above resin solution | 4 parts |
| Glycerin | 9 parts |
| Ethylene glycol | 10 parts |
| Acetylene glycol EO adduct (manufactured by Kawaken Fine Chemicals Co., Ltd.) | 1 part |
| Ion-exchanged water | 36 parts |

<Magenta Ink>

(1) Preparation of Dispersion Liquid

Using benzyl acrylate and methacrylic acid as raw materials, an AB block polymer having an acid value of 300 and a number-average molecular mass of 2500 was produced in a usual manner. Then, the AB block polymer was neutralized with a potassium hydroxide solution and diluted with ion-exchanged water, thereby preparing 50 mass percent of a homogeneous polymer solution. Further, the above polymer solution (100 g), C.I. Pigment Red 122 (100 g), and ion-exchanged water (800 g) were mixed and mechanically agitated for half an hour. Next, the mixture was processed using a microfluidizer by passing the mixture through an interaction chamber five times under a fluid pressure of about 70 MPa. Further, the obtained dispersion liquid was subjected to a centrifugal process (12000 rpm, 20 minutes), thereby removing undispersed material including coarse particles to obtain a magenta dispersion liquid. The obtained magenta dispersion liquid had a pigment concentration of 10 mass percent and a dispersant concentration of 5 mass percent.

(2) Preparation of Resin Solution

In 15.0 mass percent of a resin including styrene and acrylic acid, one equivalent weight of potassium hydroxide was added to a carboxylic acid constituting the acrylic acid, and the remaining part was adjusted with water to 100.0 mass percent. Then, the resulting product was agitated at 80° C. to dissolve the resin. Then, the resulting product was adjusted with water to have a solid content of 15.0 mass percent to obtain a resin solution. The resin had a weight-average molecular mass of 7000.

(3) Preparation of Ink

The following ingredients were added to the above magenta dispersion liquid to obtain a predetermined concentration. Then, these ingredients were sufficiently mixed and agitated, and thereafter, the mixture was filtered under pressure through a microfilter (manufactured by Fujifilm Corporation) having a pore size of 2.5 μm, thereby preparing a pigment ink having a pigment concentration of 4 mass percent and a dispersant concentration of 2 mass percent.

| | |
|---|---|
| The above magenta dispersion liquid | 40 parts |
| The above resin solution | 6.7 parts |
| Glycerin | 10 parts |
| Diethylene glycol | 10 parts |
| Acetylene glycol EO adduct | 0.5 parts |
| Ion-exchanged water | 32.8 parts |

<Cyan Ink>

(1) Preparation of Dispersion Liquid

First, using benzyl acrylate and methacrylic acid as raw materials, an AB block polymer having an acid value of 250 and a number-average molecular mass of 3000 was produced in the usual manner. Then, the AB block polymer was neutralized with a potassium hydroxide solution and diluted with ion-exchanged water, thereby preparing 50 mass percent of a homogeneous polymer solution. Further, the above polymer solution (100 g), C.I. Pigment Blue 15:3 (100 g), and ion-exchanged water (800 g) were mixed and mechanically agitated for half an hour. Next, the mixture was processed using a microfluidizer by passing the mixture through an interaction chamber five times under a fluid pressure of about 70 MPa. Further, the obtained dispersion liquid was subjected to a centrifugal process (12000 rpm, 20 minutes), thereby removing undispersed material including coarse particles to obtain a cyan dispersion liquid. The obtained cyan dispersion liquid had a pigment concentration of 10 mass percent and a dispersant concentration of 5 mass percent.

(2) Preparation of Resin Solution

In 15.0 mass percent of a resin including styrene and acrylic acid, one equivalent weight of potassium hydroxide was added to a carboxylic acid constituting the acrylic acid, and the remaining part was adjusted with water to 100.0 mass percent. Then, the resulting product was agitated at 80° C. to dissolve the resin. Then, the resulting product was adjusted with water to have a solid content of 15.0 mass percent to obtain a resin solution. The resin had a weight-average molecular mass of 7000.

(3) Preparation of Ink

The following ingredients were added to the above cyan dispersion liquid to obtain a predetermined concentration. Then, these ingredients were sufficiently mixed and agitated, and thereafter, the mixture was filtered under pressure using a microfilter (manufactured by Fujifilm Corporation) having a pore size of 2.5 μm, thereby preparing a pigment ink having a pigment concentration of 2 mass percent and a dispersant concentration of 2 mass percent.

| | |
|---|---|
| The above cyan dispersion liquid | 20 parts |
| The above resin solution | 7.3 parts |
| Glycerin | 10 parts |
| Diethylene glycol | 10 parts |
| Acetylene glycol EO adduct | 0.5 parts |
| Ion-exchanged water | 52.2 parts |

To all the inks according to the present exemplary embodiment prepared as described above, a resin component is added in addition to a dispersion liquid resin. This enables the suppression of bronzing so that the color of the specularly reflected light does not become tinged with a color when light from a light source has been projected onto an image. Further, the abrasion resistance can be improved.

In the present exemplary embodiment, glossy paper is used as a recording medium. The present invention is applicable not only to glossy paper serving as a recording medium but also to any recording medium on the surface of which an absorbing layer for absorbing the solvent components of the inks is formed.

Next, when inks were fixed in a laminated manner, the dot diameter of the ink applied on top was measured, thereby evaluating the penetration inhibiting power of the ink applied underneath.

The relationship between the penetration inhibiting power and the dot diameter of inks is described below.

FIGS. 6A1 to 6B3 are diagrams illustrating the difference in dot diameter between first and second inks discharged onto glossy paper 51 which is a recording medium, when the order of application is changed. The first ink has a relatively strong penetration inhibiting power when applied under another ink, the second ink has a relatively weak penetration inhibiting power when applied under another ink.

FIGS. 6A1, 6A2, and 6A3 illustrate a fixing process of the first ink when the first ink is applied later to an area where the second ink has been applied first.

Figure 1A:
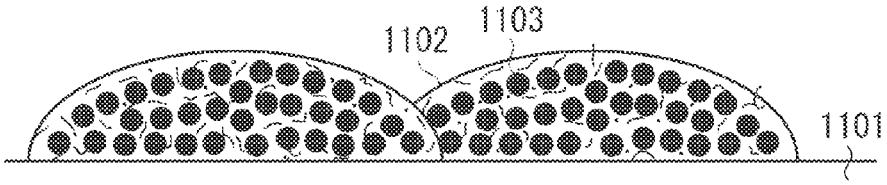
FIGS. 1A, 1B, and 1C are diagrams illustrating the process of the fixing of a plurality of pigment inks when the pigment inks have been applied in a laminated manner.
Figure 1B:
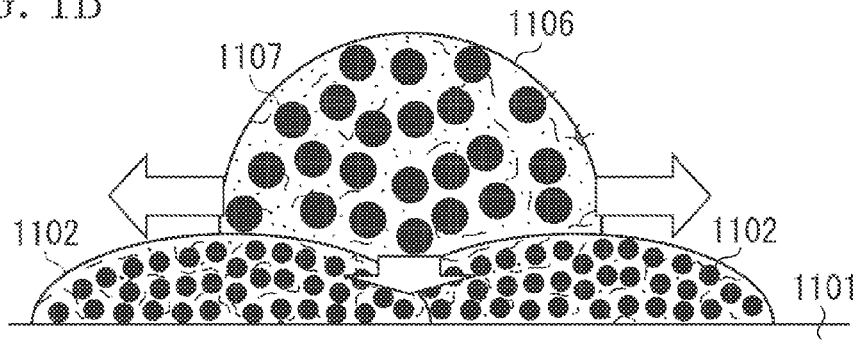
Figure 1C:
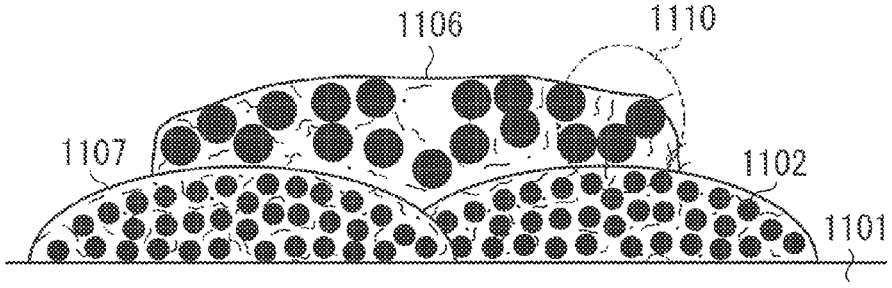
Figure 2A:
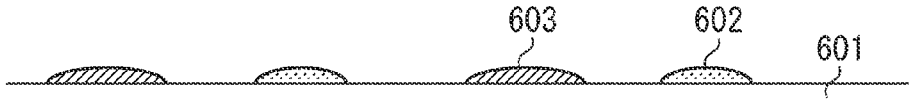
FIGS. 2A to 2B are diagrams illustrating the surface of a recording medium when recording has been performed using a plurality of pigment inks.
Figure 2B:
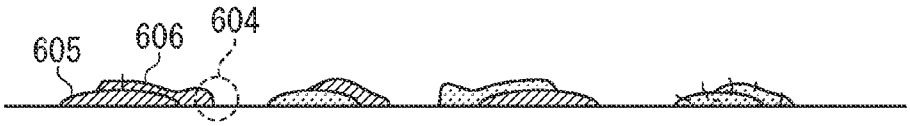

As illustrated in FIG. 6A1, the solvent component of a first ink 53 discharged onto the layer of a second ink 52 fixed on the glossy paper 51 penetrates in large amounts into the glossy paper 51 through the layer of the second ink 52 as indicated by an arrow 55 in FIG. 6A2, because the second ink 52 has a weak penetration inhibiting power. Thus, it is difficult for the first ink 53 to spread on the layer of the second ink 52 as indicated by arrows 54. Thus, as illustrated in FIG. 6A3, the first ink 53 hardly spreads on the layer of the second ink 52 after the application of the first ink 53 as illustrated in FIG. 6A1, even immediately after the application. As a result, the dot diameter of the first ink 53 is X1.

On the other hand, FIGS. 6B1, 6B2, and 6B3 illustrate a fixing process of the second ink when the first ink is applied first, and the second ink has been applied on top of the first ink in a laminated manner.

Contrary to the case illustrated in FIG. 6A1, the same amount of the second ink 52 as the discharge amount of the first ink 53 in FIG. 6A1 is applied to the first ink 53 fixed on the glossy paper 51 as in FIG. 6B1. The first ink 53 applied underneath has a strong penetration inhibiting power, and therefore, the second ink 52 can penetrate only in small amounts into the glossy paper 51 through the layer of the first ink 53 as indicated by an arrow 55 in FIG. 6B2. Thus, as indicated by arrows 54 in FIG. 6B2, the flow of the second ink 52 increases in the directions of spreading on the layer of the first ink 53. As a result, the dot diameter of the second ink 52 fixed on the layer of the first ink 53 is X2, which is larger than X1.

In the present exemplary embodiment, an image is formed by discharging an ink with a high recording duty to cover an entire surface area having a predetermined size of glossy paper, which is a recording medium, and the diameter of a dot formed by discharging a drop of a different ink onto the image is measured, thereby evaluating the penetration inhibiting power of the ink.

The recording duty represents the recording density of dots. The recording duty is defined as 100% when an image has been formed by recording the dots with 4.5 pl of ink, in areas corresponding to all pixels in a grid of 1200×1200 dpi.

A method of measuring a dot diameter is described in detail below, taking the magenta ink and the black ink as examples.

Figure 7A:
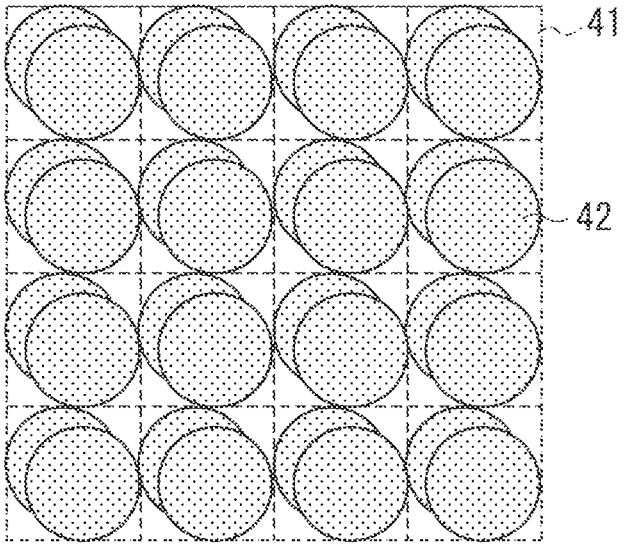
FIGS. 7A and 7B are diagrams illustrating a method of measuring a dot diameter according to the exemplary embodiment.
Figure 7B:
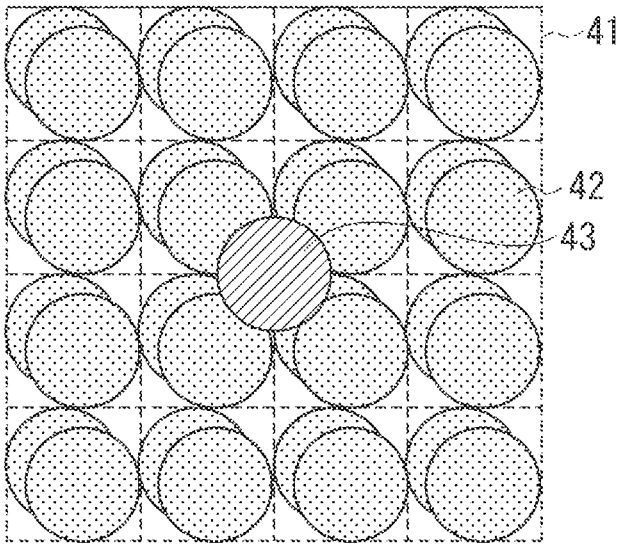

FIGS. 7A and 7B are diagrams illustrating the process of measuring a dot diameter.

First, as illustrated in FIG. 7A, two dots 42, each formed with 4.5 pl of the magenta ink, are applied to an area 41, which corresponds to the individual pixels in an area corresponding to 16 pixels within a grid of 1200×1200 dpi on a recording medium. The grid separating the individual pixels 41 is formed at intervals of 1200 dpi.

In FIG. 7A, the dots 42 do not appear to completely cover the areas in the grid on the recording medium. The dots 42, however, are represented to be smaller merely for convenience. The actual dot diameter is about 40 μm, and the distance between adjacent pixels is sufficiently greater than about 21 μm, which is one-twelve-hundredth of an inch. Thus, the ink covers the entire areas in the grid on the recording medium. Hereinafter, such an image is referred to as a "solid image".

Next, FIG. 7B illustrates the state where only one dot 43 of the black ink is applied on top of the dots 42. In the present exemplary embodiment, the diameter of the dot 43 is referred to as the dot diameter of the black ink relative to the magenta ink fixed on the recording medium.

To accurately measure the diameter of the dot 43 fixed on the solid image, the diameter of the dot 43 is measured using a microscope several seconds after the application of the dot 43. The microscope may be of any type. In the present exemplary embodiment, the measurements were made using a measuring microscope STM-UM (manufactured by Olympus Corporation). In the present exemplary embodiment, a plurality of diameters of the dot 43 was measured, and the average value of the plurality of diameters was evaluated as the diameter of the dot 43.

Similarly, the order of application of the magenta ink and the black ink is reversed to obtain the dot diameter of the magenta ink relative to the black ink fixed on the recording medium. Further, the combination and the order of application of two inks are appropriately changed to obtain the dot diameters based on the combinations and the orders of application of all inks used in the present exemplary embodiment.

Table 1 illustrates the dot diameters of the inks used in the present exemplary embodiment, the dot diameters measured by the above method.

TABLE 1

| | | Dot on Top | | | |
|---|---|---|---|---|---|
| | | K | C | M | Y |
| Solid | K | | 65 | 66 | 67 |
| | C | 59 | | 60 | 60 |
| | M | 53 | 50 | | 54 |
| | Y | 55 | 50 | 49 | |

unit (μm)

With reference to Table 1, it is understood that, for example, the dot diameter of the black ink relative to the magenta ink fixed on the recording medium is 53 μm, and the dot diameter of the magenta ink relative to the black ink fixed on the recording medium is 66 μm. Thus, by comparing the magenta ink with the black ink, it can be determined that the black ink has a stronger penetration inhibiting power when applied under the other.

Further, similarly considering the combination of the black ink and the cyan ink and the combination of the black ink and the yellow ink, it is understood that the black ink has a stronger penetration inhibiting power than the other inks.

Thus, similarly considering the combinations of all inks with reference to Table 1, it can be determined that the black ink has the strongest penetration inhibiting power, followed by the cyan ink, the magenta ink, and the yellow ink.

The cause of the generation of the penetration inhibiting power of an ink is described in detail below.

Figure 8A:
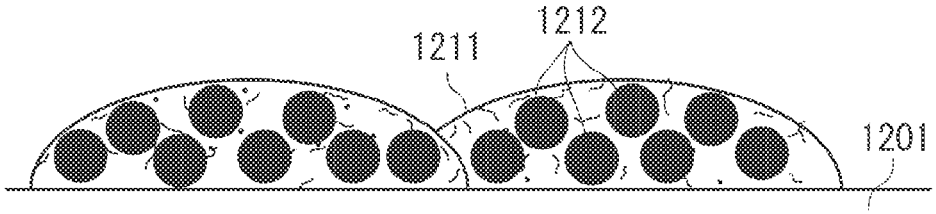
FIGS. 8A and 8B are diagrams illustrating the relationship between the primary particle diameter of a pigment and the penetration inhibiting power.
Figure 8B:
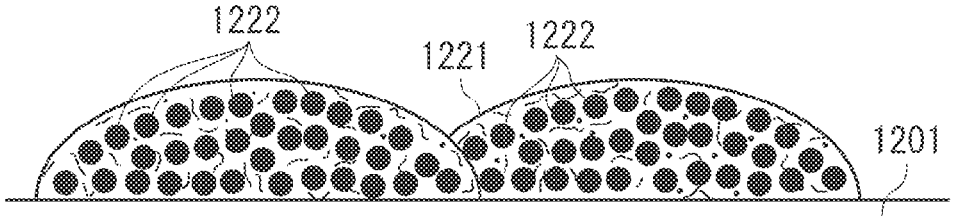

FIGS. 8A and 8B are diagrams illustrating the correlation between the particle diameter of a pigment and the penetration inhibiting power.

FIG. 8A is a schematic diagram illustrating a cross section of dots when an ink containing a pigment having a relatively large particle diameter has been fixed on a recording medium. Further, FIG. 8B is a schematic diagram illustrating a cross section of dots when an ink containing a pigment having a relatively small particle diameter has been fixed on a recording medium.

As described above, each pigment ink used in the present exemplary embodiment is fixed when a pigment, which is a color material component, has become deposited on a recording medium. The pigments have different particle diameters depending on the type. Thus, if an ink containing a pigment having a large particle diameter is used, the density of the pigment is small as illustrated in FIG. 8A. If an ink containing a pigment having a small particle diameter is used, the density of the pigment is great as illustrated in FIG. 8B.

If the pigment has a larger particle diameter, there is a larger space between the particles of the pigment in the fixed ink. Thus, the solvent component of the ink to be applied on top of the fixed ink can easily penetrate into the fixed ink. In contrast, if the pigment has a smaller particle diameter, the particles are densely present in the pigment without a space therebetween. Thus, it is difficult for the solvent component of the ink applied on top of the fixed ink to penetrate into the fixed ink compared with the case where the pigment has a larger particle diameter. Thus, the penetration inhibiting power is considered to increase.

Even after the ink has been fixed on the surface of the recording medium, the pigment is considered to include primary particles in a dispersed state similar to a state before the ink is fixed. Thus, to accurately evaluate the penetration inhibiting power, it is desirable to measure the particle diameter of the pigment in the form of primary particles.

For example, carbon black, which is the pigment of the black ink used in the present exemplary embodiment, is normally present in the form of secondary particles having a particle diameter of about 90 nm. In a dispersed state in the ink, however, carbon black is present in the form of primary particles having a particle diameter of about 20 nm. Thus, the penetration inhibiting power is evaluated by adopting a value of about 20 nm as the particle diameter of the pigment in the present exemplary embodiment.

Further, a resin component is added to each of the inks used in the present exemplary embodiment, in order to reduce bronzing and improve the abrasion resistance. The resin component includes a polymer, and therefore has a large molecular mass. Thus, the resin component is considered to prevent the penetration of ink. Further, the resin component also functions to connect the particles of the pigment, and therefore, it can be considered that the greater the amount of the resin component contained in the ink, the higher the penetration inhibiting power of the ink.

Based on the above, in a system where inks are fixed on a recording medium in a laminated manner, it is considered that the smaller the particle diameter of the pigment contained in the ink applied underneath or the more resin component the ink applied underneath contains, the stronger the penetration inhibiting power against the ink applied on top.

Table 2 illustrates the average particle diameter of the pigment contained in each ink used in the present exemplary embodiment.

TABLE 2

| Type of Ink | Average Particle Diameter |
|---|---|
| Black | 20 |
| Cyan | 80 |
| Magenta | 90 |
| Yellow | 110 |

unit (nm)

These average particle diameters were measured using a Nanotrac granularity analyzer (manufactured by Nikkiso Co., Ltd.). Further, the average particle diameter of each ink was evaluated based on the particle diameter of primary particles.

Further, Table 3 illustrates the ratio of the pigment to the resin component (the pigment/the resin component) contained in each ink used in the present exemplary embodiment.

TABLE 3

| Type of Ink | Pigment/Resin |
|---|---|
| Black | 1.11 |
| Cyan | 0.95 |
| Magenta | 1.33 |
| Yellow | 1.33 |

It can be said that the smaller the value, the greater the amount of the resin component contained in the ink.

Figure 9:
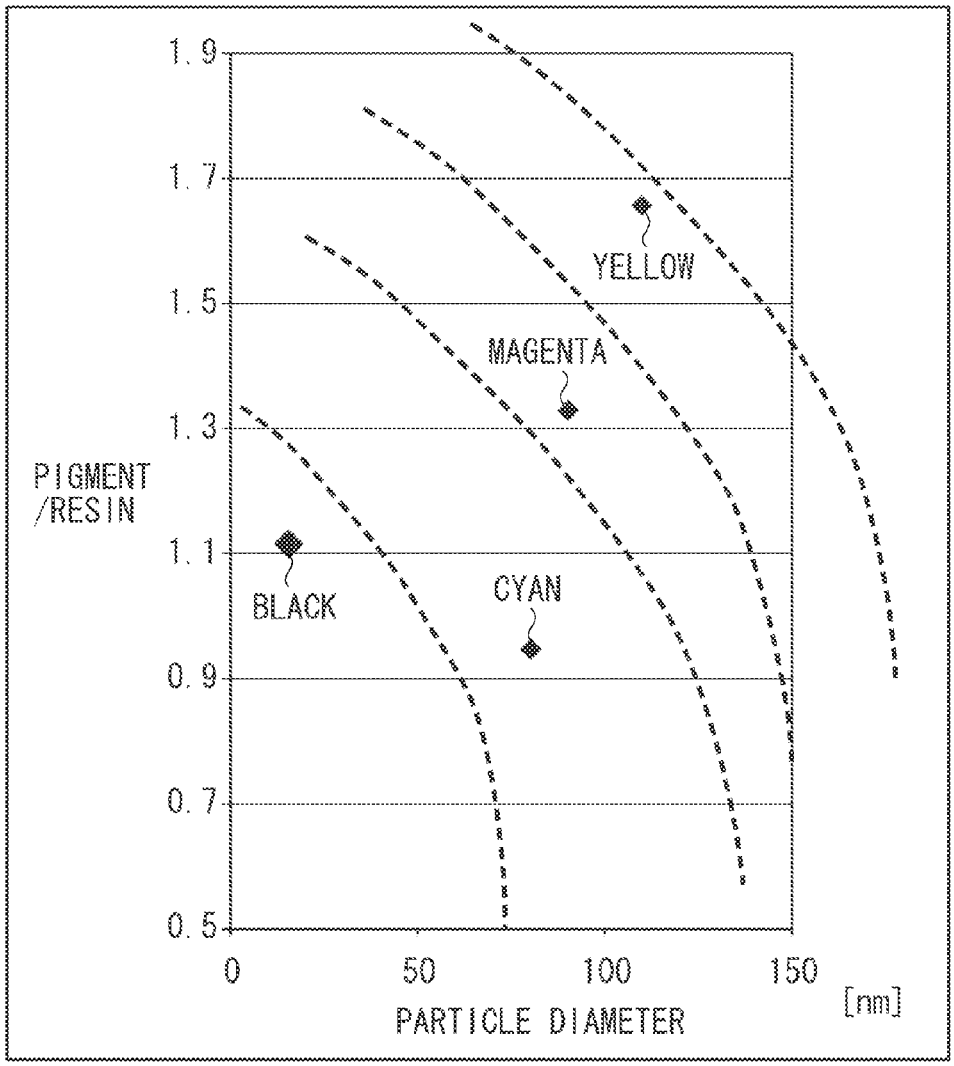
FIG. 9 is a diagram illustrating the relationship between the primary particle diameter of a pigment and the amount of a resin component, and the penetration inhibiting power.

FIG. 9 is a diagram in which the horizontal axis indicates the average particle diameter of the pigment illustrated in Table 2, the vertical axis indicates the ratio of the pigment to the resin component illustrated in Table 3, and the value of each ink is plotted. By comparing the strengths of the penetration inhibiting powers that can be determined from FIG. 9 and Table 1, it can be confirmed that there is a tendency that the closer to the lower left of the diagram, that is, the smaller the particle diameter of the pigment and the greater the amount of the contained resin component, the stronger the penetration inhibiting power.

As factors for determining the strength of the penetration inhibiting power, the particle diameter of the pigment and the amount of the contained resin component have been described. The penetration inhibiting power, however, is considered to vary depending on various other factors. For example, the penetration inhibiting power may vary depending on the acid values, the molecular masses, and the dissolved states of the pigment and the resin component. Therefore, in the present invention, the dot diameters resulting from the differences between the penetration inhibiting powers are obtained to evaluate the penetration inhibiting powers, whereby the optimal order of application of the inks can be determined.

Table 4 illustrates the values of the image clarity obtained when recording was performed by differentiating the order of application of the black ink and the magenta ink used in the present exemplary embodiment.

TABLE 4

| Printing Order | Print From Magenta To Black | Print From Black To Magenta | Simultaneously Print Black and Magenta |
|---|---|---|---|
| Image Clarity | 38.5 | 30 | 28.9 |

unit (%)

The image clarity was measured according to an image clarity measurement method (JIS-K7105). It is indicated that the greater the value, the higher the image clarity. Further, each of the magenta ink and the black ink is used to perform recording with a recording duty of 100%.

With reference to Table 4, it is understood that as compared to the configuration in which the black ink is applied first to the recording medium and the configuration in which the black ink and the magenta ink are simultaneously applied to the recording medium without particularly setting the order of application of the black ink and the magenta ink, the configuration in which the magenta ink is applied first has the most excellent image clarity. Thus, it can be determined also by experiment that if an ink having a small penetration inhibiting power is applied first, and an ink having a large penetration inhibiting power is applied on top of the first ink, the deterioration of the image clarity can be reduced.

Thus, in the present exemplary embodiment, the order of application is controlled so that the yellow ink, the magenta ink, the cyan ink, and then the black ink are applied to the recording medium in this order, thereby reducing the deterioration of the image clarity.

A recording control method according to the present exemplary embodiment is described in detail below.

In the present exemplary embodiment, recording is performed according to a multipath recording method for completing the recording of an image in a unit area on a recording medium by 16 recording scans.

Figure 10:
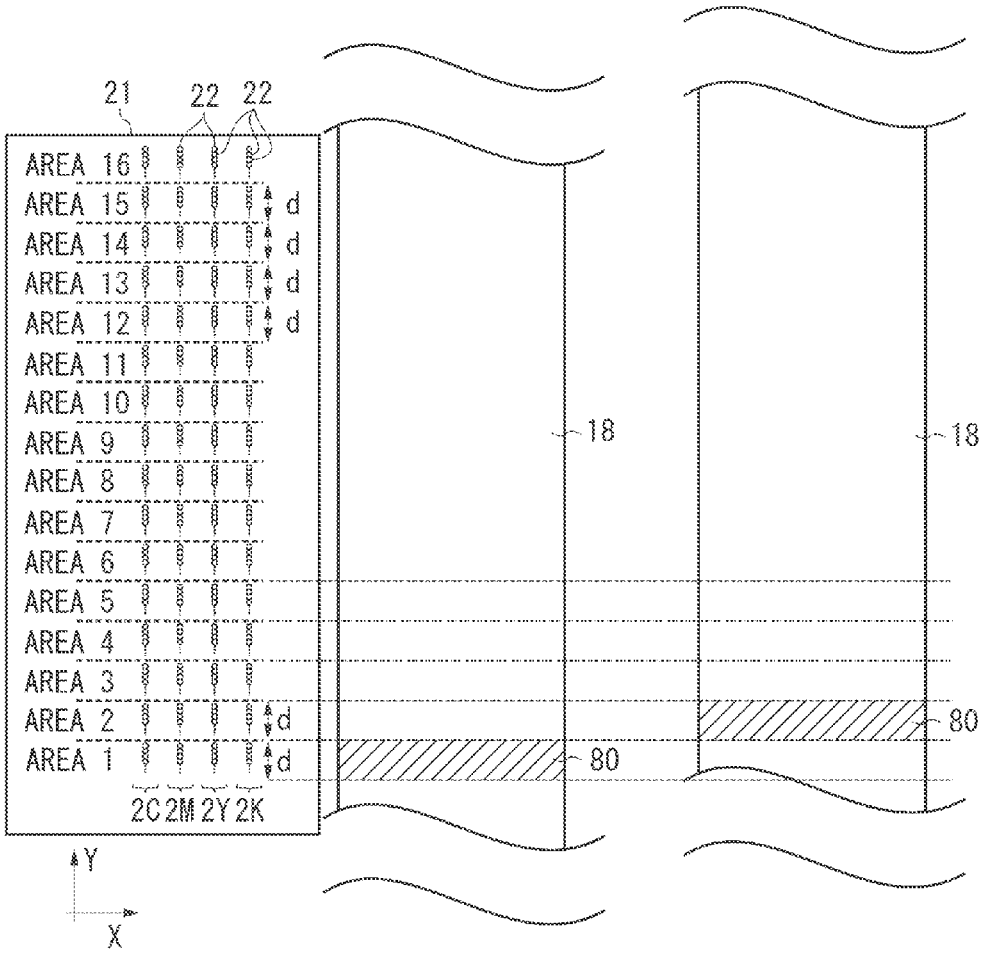
FIG. 10 is a diagram illustrating a multipath recording method according to the exemplary embodiment.

FIG. 10 is a diagram illustrating the multipath recording method adopted in the present exemplary embodiment.

Each of the discharge port arrays 2C, 2M, 2Y, and 2K has the same number of discharge ports and is divided into 16 areas from areas 1 to 16, each having a length d.

A unit area 80 in a recording medium is an area corresponding to the amount of relative movement between the recording head 21 and the recording medium 18 in the Y-direction. The unit area 80 corresponds to an area having the length d in the divided discharge port arrays 2C, 2M, 2Y, and 2K.

First, when the unit area 80 in the recording medium 18 is at a position 80*a*, while the recording head 21 scans in the X-direction, the ink is discharged from the discharge ports belonging to the area 1 of the discharge port arrays 2C, 2M, 2Y, and 2K to the unit area 80 according to a mask pattern.

Then, the recording medium 18 is conveyed a distance corresponding to the distance d in the Y-direction, thereby moving the unit area 80 to a position 80*b*.

After the conveyance, while the recording head 21 scans in the X-direction, the inks are discharged from the discharge ports belonging to the area 2 to the unit area 80 in the recording medium 18. To the unit area 80, the inks was earlier discharged from the discharge ports belonging to the area 1. Thereafter, the recording medium 18 is thus conveyed a distance corresponding to the distance d, while the recording head 21 is scanned 16 times on the unit area 80 in the recording medium 18, thereby completing an image.

Figure 11:
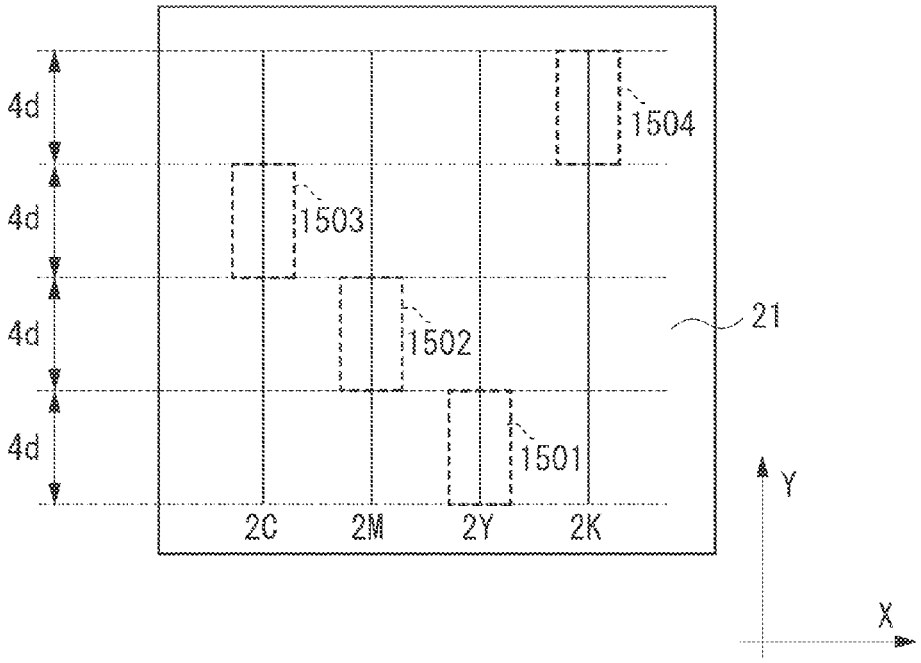
FIG. 11 is a diagram illustrating the use range of discharge ports according to the exemplary embodiment.

FIG. 11 is a diagram illustrating the use range of the discharge ports of the discharge port arrays 2C, 2M, 2Y, and 2K when the multipath recording method according to the present exemplary embodiment is performed.

In the present exemplary embodiment, the use ranges of the discharge ports are differentiated according to the type of ink to be discharged.

The discharge port array 2C for the cyan ink uses discharge ports 1503 belonging to four areas from the areas 9 to 12 for recording. The discharge port array 2M for the magenta ink uses discharge ports 1502 belonging to the areas 5 to 8 for recording. The discharge port array 2Y for the yellow ink uses discharge ports 1501 belonging to the areas 1 to 4 for recording. The discharge port array 2K for the black ink uses discharge ports 1504 belonging to the areas 13 to 16 for recording.

Figure 12:
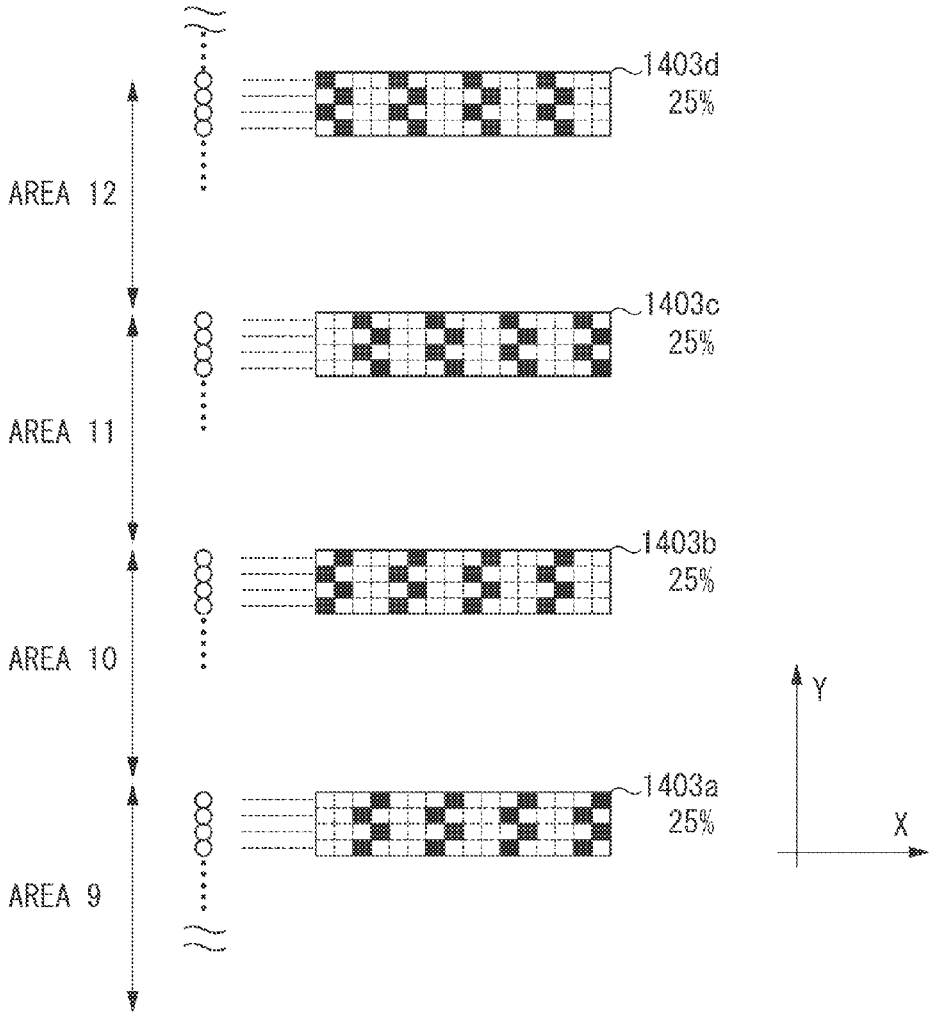
FIG. 12 is a diagram illustrating mask patterns applied to the exemplary embodiment.

Further, FIG. 12 is a diagram illustrating mask patterns to be applied to the discharge ports belonging to the use range of the discharge port array 2C for discharging the cyan ink in the present exemplary embodiment.

FIG. 12 illustrates only mask patterns to be applied to the discharge ports 1503 belonging to the use range of the discharge port array 2C for the cyan ink for simplicity.

A mask pattern is formed by arranging recording permission pixels and recording non-permission pixels in a particular pattern. For each recording permission pixel, if input image data is image data requesting the discharge of ink, recording data for actually discharging ink is generated. Further, for each recording non-permission pixel, even if input image data is image data requesting the discharge of ink, recording data indicating that ink is not to be discharged is generated. In each of the mask patterns illustrated in FIG. 12, a portion represented in black indicates a recording permission pixel, and a portion represented in white indicates a recording non-permission pixel.

In FIG. 12, each mask pattern has an area of 16×4 pixels for simplicity, but the actual mask pattern has an area larger in both the X-direction and the Y-direction.

To the four areas from the areas 9 to 12, mask patterns 1403*a*, 1403*b*, 1403*c*, and 1403*d* are applied. For each of the mask patterns 1403*a*-*d*, the recording permission rate, which is the presence ratio of recording permission pixels to all the pixels, is set to 25%. In these mask patterns, each recording permission pixel is placed at an exclusive position. Thus, the logical addition of the mask patterns 1403*a*, 1403*b*, 1403*c*, and 1403*d* corresponds to all pixels in the unit area.

Further, to the areas other than the four areas 9 to 12, mask patterns are applied in which the recording permission rate is set to 0%. Thus, the ink is not discharged from the discharge ports belonging to these areas.

The application of such mask patterns enables the discharge of the cyan ink to all areas in the unit area only by performing ninth to twelfth recording scans in which the ink is discharged from the discharge ports 1503 belonging to the four areas 9 to 12.

Similarly, in the discharge port array 2M for discharging the magenta ink, mask patterns similar in shape to the mask patterns 1403*a*, 1403*b*, 1403*c*, and 1403*d* are applied to the four areas from the areas 5 to 8. The four areas correspond to the discharge port 1502 belong to the use range of the discharge port array 2M. Further, to the areas other than the four areas 5 to 8, mask patterns are applied in which the recording permission rate is set to 0%. This enables the discharge of the magenta ink to areas corresponding to all pixels in the unit area only by performing fifth to eighth recording scans.

Similarly, the yellow ink is discharged to all pixels in the unit area only by performing first to fourth recording scans, and the black ink is discharged to all pixels in the unit area only by performing thirteenth to sixteenth recording scans.

In the present exemplary embodiment, the above configuration enables the application of inks to all areas in the recording medium in the order of the yellow ink, the magenta ink, the cyan ink, and the black ink.

Table 5 illustrates the comparison between the image clarity of an image recorded according to the above recording method and the image clarity of an image recorded by discharging a plurality of inks by the same recording scan.

TABLE 5

| Combination of Inks | Printing Order: (Present Invention) Yellow, Magenta, Cyan, and Black in This Order | Printing Order: (Comparative Example) All Colors Simultaneously, Using 16 Passes |
|---|---|---|
| Yellow 100% + Black 100% | 42.5 | 33.1 |
| Magenta 100% + Black 100% | 38.5 | 28 |
| Cyan 100% + Black 100% | 38.6 | 29.8 |

TABLE 5-continued

| Combination of Inks | Printing Order (Present Invention) Yellow, Magenta, Cyan, and Black in This Order | Printing Order (Comparative Example) All Colors Simultaneously, Using 16 Passes |
|---|---|---|
| Yellow 100% + Magenta 100% | 40.4 | 39.5 |
| Cyan 100% + Yellow 100% | 37.7 | 35.4 |
| Cyan 100% + Magenta 100% | 37.2 | 32.1 |

Unit (%)

As can be understood from Table 5, according to the present exemplary embodiment, it is possible to reduce the unevenness of an image which occurs when dots become bulky, in all the combinations of two types of inks. This enables the suppression of the decrease in the image clarity.

In the present exemplary embodiment, all the four inks are applied in the ascending order of the penetration inhibiting power. The order of application of all the inks, however, does not necessarily need to be controlled. For example, the order of application of the inks may be controlled such that the yellow ink, the magenta ink, and then the cyan ink are applied in this order, while not particularly setting the order of application for the black ink. Also in such a case, it is possible to reduce the deterioration of the image clarity more than in a case where the order of application is not particularly set for any of the inks.

Further, in the present exemplary embodiment, the unit area is an area having a length corresponding to an area of the divided discharge port arrays and having a width corresponding to the full width of the recording medium. The unit area according to the present invention, however, is not limited to such an area. For example, the unit area may be an area in the recording medium that has a length corresponding to the length of the recording head and has a width corresponding to the full width of the recording medium, or may be an area in the recording medium that corresponds to an area of 16×4 pixels, which is the size of the mask patterns.

In the first exemplary embodiment, a description has been given of the configuration in which all the inks are applied in a particular order.

In contrast, in a second exemplary embodiment, a description is given of the configuration in which some inks are applied by the same recording scan, and the order of application is controlled only with respect to the combination of inks that contribute greatly to the deterioration of the image clarity.

An ink of each color used in the present exemplary embodiment is the same as that used in the first exemplary embodiment.

As illustrated in Table 1, in the combination of the magenta ink and the yellow ink, the difference in dot diameter caused by varying the order of application is small, namely 5 μm. Thus, as can be understood from Table 5, the change in the image clarity in the combination of the magenta ink and the yellow ink is also smaller than those in the other combinations of the inks.

Thus, in the present exemplary embodiment, the magenta ink and the yellow ink are discharged from the discharge ports belonging to the areas 1 to 8, according to mask patterns in which the recording permission rate is set to 12.5%.

According to the present exemplary embodiment, it is possible to increase the number of discharge ports to be used for the recording by the discharge port array 2M for the magenta ink and the discharge port array 2Y for the yellow ink. This can reduce the local use of discharge ports. Thus, it is possible to further enhance the life of the recording head.

In a third exemplary embodiment, a description is given of the configuration in which mask patterns are switched. More particularly, a mask pattern used in controlling the order of application of inks according to the amount of discharge of ink, and a mask pattern for applying the same ink to the unit area by the same recording scan without setting a particular order of application, are switched.

An ink of each color used in the present exemplary embodiment is the same as that used in the first exemplary embodiment.

Table 6 illustrates a difference in image clarity when the magenta ink and the black ink are applied to an area in a recording medium that has a width of one inch in the X-direction and the Y-direction, by changing the recording duty from 50% to 200%. The values in Table 6 indicate the differences in image clarity between an image obtained by controlling the order of application such that the magenta ink and then the black ink are applied in this order, and an image recorded by simultaneously applying the magenta ink and the black ink by the same recording scan.

TABLE 6

| | | Recording Duty of Magenta Ink 50% | 100% | 150% | 200% |
|---|---|---|---|---|---|
| Recording Duty of Black Ink | 50% | 3.96 | 4.04 | 3.21 | 5.11 |
| | 100% | 8.00 | 10.50 | 10.27 | |
| | 150% | 7.46 | 13.41 | | |
| | 200% | 5.09 | | | |

unit (%)

With reference to Table 6, it is understood that the greater the total recording duty of the magenta ink and the black ink, the more effective the decrease in the deterioration of the image clarity which is achieved by controlling the order of application of the inks. It is considered that this is because the greater the total recording duty, the greater the number of dots to be formed in the unit area. This increases areas where the inks overlap with each other, and therefore, the dots can easily become bulky and increase the unevenness of the surface of the image.

In the present exemplary embodiment, particularly when the total recording duty is equal to or greater than 200%, that is, when the deterioration of the image clarity can be effectively decreased, a mask pattern for controlling the order of application is applied. In cases other than that, a mask pattern is applied for which the same recording permission rate is set in each recording scan, and which uses the entire discharge port arrays.

Figure 13:
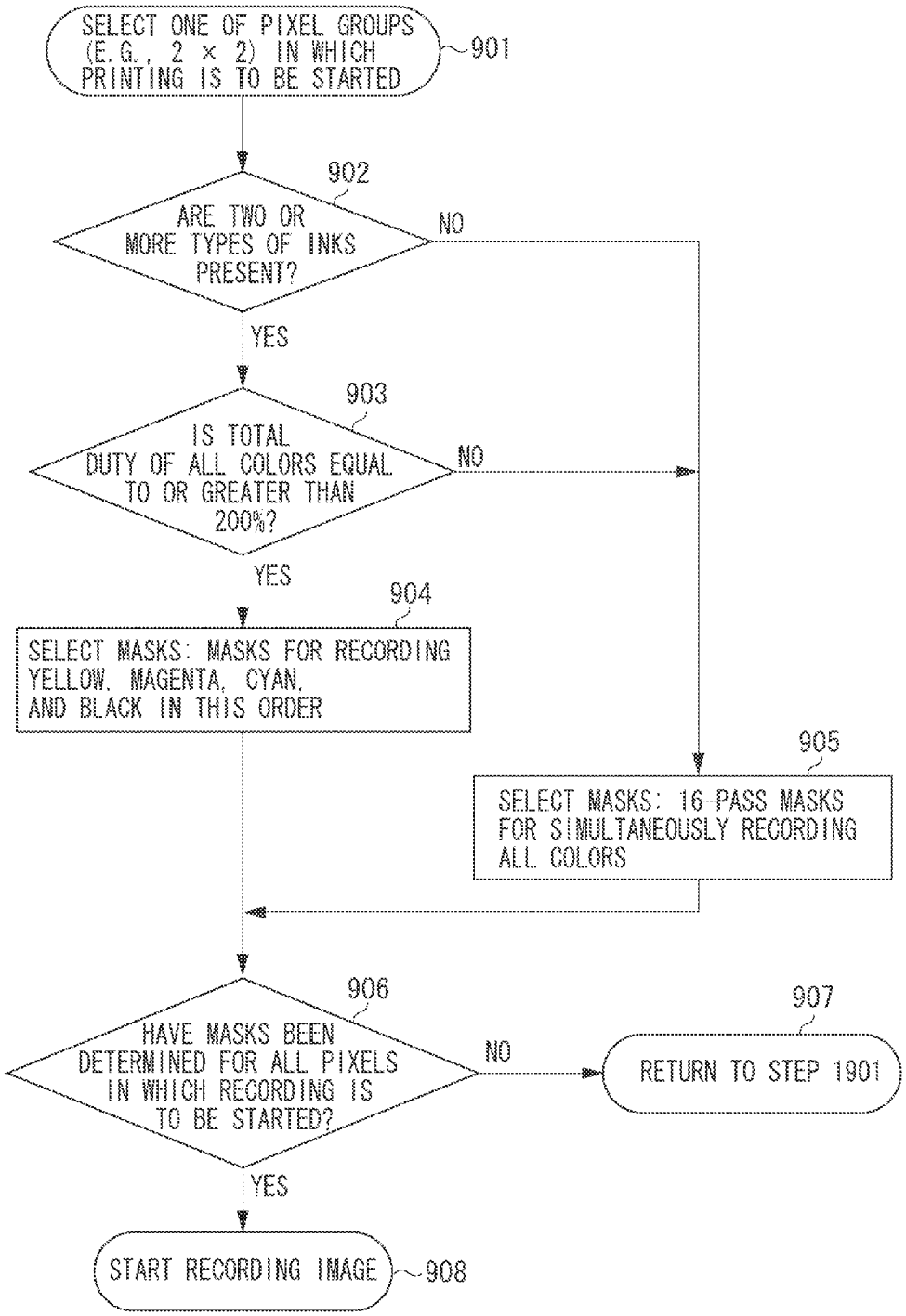
FIG. 13 is a flow chart illustrating the configuration of a recording control system according to a third exemplary embodiment.

FIG. 13 is a flow chart illustrating the general configuration of recording control according to the present exemplary embodiment.

First, in step 901, all pixels in the unit area are divided into a plurality of pixel groups, each including four pixels having two pixels in each of the X-direction and the Y-direction, and the determination of the recording duty is started with respect to each pixel group. In this case, each pixel group may only need to include a plurality of pixels, and the number of pixels in the pixel group is not particularly limited.

In step 902, it is determined with respect to each pixel group whether or not recording data corresponding to a plurality of inks is present. If it has been determined that recording data corresponds to only one type of ink (NO in step 902), the processing proceeds to step 905, and a standard mask pattern is applied. If it has been determined that recording data corresponding to a plurality of inks is present (YES in step 902), the processing proceeds to step 903.

In step 903, the total recording duty of the plurality of inks is determined with respect to each pixel group. That is, the number of dots is determined based on binarized recording data, thereby determining the total recording duty. If it has been determined that the total recording duty is less than 200% (NO in step 903), the processing proceeds to step 905, and a mask pattern is applied for which the same recording permission rate is set in each recording scan. If it has been determined that the total recording duty is equal to or greater than 200% (YES in step 903), the processing proceeds to step 904, and a mask pattern for controlling the order of application is applied.

After the mask pattern has been applied to the recording data of the pixel group in step 904 or 905, the processing proceeds to step 906. In step 906, it is determined whether or not a mask pattern has been applied to the pixels in all pixel groups. In the present exemplary embodiment, the number of dots are determined based on binarized recording data. Alternatively, various methods are applicable so long as the total recording duty can be determined. For example, the total recording duty may be determined based on data indicated by multiple values before binarization.

If there is a pixel to which a mask pattern has not been applied (NO in step 906), then in step 907, a similar determination is made with respect to another pixel group again from step 901. If a mask pattern has been applied to all pixels (YES in step 906), the processing proceeds to step 908, and recording is performed.

According to the present exemplary embodiment, if the recording duty is low, the discharge ports in the entire ranges of the discharge port arrays are used. This can reduce the local use of discharge ports, similarly to the second exemplary embodiment. Thus, it can be expected that the recording head can be used for a long period. If, on the other hand, the recording duty is high, the order of application of the inks is controlled, whereby it is possible to achieve an excellent image clarity.

In the present exemplary embodiment, the recording duty is evaluated based on binary data. Alternatively, the recording duty may be evaluated based on multi-valued data having three or more values before binarization.

Further, in the first to third exemplary embodiments, the use ranges of the discharge ports are differentiated in the Y-direction between the discharge port arrays, thereby controlling the order of application of the inks. Alternatively, the discharge port arrays may be placed at positions different in the Y-direction, thereby controlling the order of application.

Further, in the first to third exemplary embodiments, a recording scan for discharging no ink may be performed between two recording scans for discharging different inks. A recording scan for discharging no ink is performed between two recording scans, thereby extending the time between the discharges of different inks. This enables the solvent component of the first applied ink to penetrate sufficiently into the recording medium, and therefore can effectively prevent dots of the ink to be applied later, from becoming bulky.

In the above exemplary embodiments, a description has been given of the configuration in which multiple scans are performed on the unit area in the recording medium to complete an image.

In contrast, in a fourth exemplary embodiment, a description is given of the configuration in which a single recording scan is performed on the unit area to complete an image.

An ink of each color used in the present exemplary embodiment is the same as that used in the first exemplary embodiment.

Figure 14:
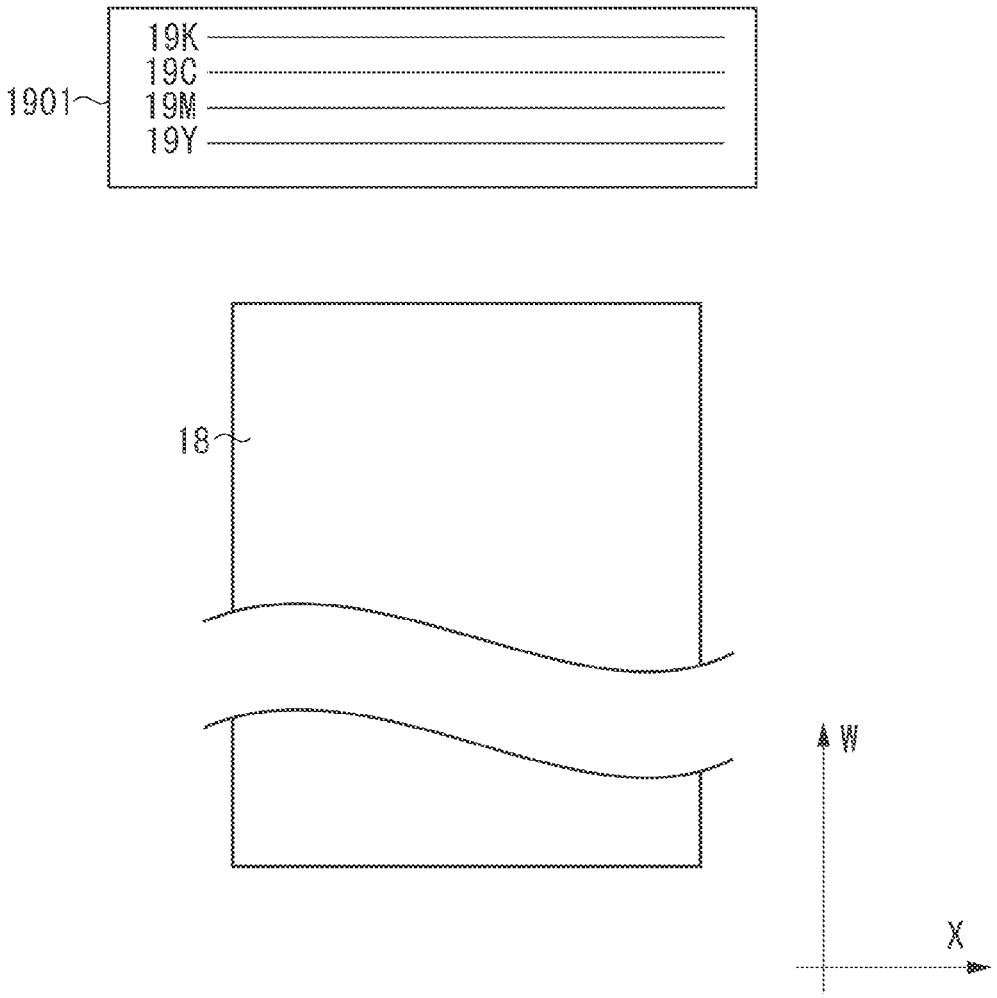
FIG. 14 is a diagram illustrating a recording apparatus applied to a fourth exemplary embodiment.

FIG. 14 is a diagram illustrating a recording control apparatus according to the present exemplary embodiment.

A recording head 1901 includes discharge port arrays 19Y, 19M, 19C, and 19K, in which a predetermined number of discharge ports for discharging respective inks are arranged in a Z-direction. Each of the discharge port arrays 19Y, 19M, 19C, and 19K has at least a length corresponding to the width of the recording medium 18 in the Z-direction. The discharge port arrays 19Y, 19M, 19C, and 19K are arranged in this order in a W-direction, which intersects the Z-direction.

While the recording medium 18 is conveyed in the W-direction relative to the recording head 1901, inks are discharged from the discharge port arrays 19Y, 19M, 19C, and 19K to complete an image on the recording medium 18.

Such a recording apparatus can also apply inks to all areas in the recording medium in the ascending order of the penetration inhibiting power, and therefore can decrease the deterioration of the image clarity. Further, the recording apparatus can complete an image by a single recording scan, and therefore can also shorten the recording time.

In the present exemplary embodiment, the recording head includes long discharge port arrays having a length corresponding to the width of the recording medium in the Z-direction. Alternatively, the recording head can be a so-called connection head which has a plurality of discharge port arrays short. In the connection head, the plurality of discharge port arrays are arranged zigzag in the Z-direction such that discharge ports arrayed in an one side of edge in the Z-direction of one discharge port array and discharge ports arrayed in the other side of edge in the Z-direction of discharge port array adjoined to the one discharge port array in the Z-direction are able to eject ink to same area on the recording medium to obtain long discharge port arrays.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Further, in the above exemplary embodiments, a description has been given of the configuration in which in areas corresponding to the pixels in the unit area in the recording medium, pixels formed by applying the second color ink and then the first color ink in this order are greater than pixels formed by applying the first color ink and then the second color ink in this order. In this case the dot diameter of the ink applied on top of the second color ink is relatively small, and the dot diameter of the ink applied on top of the first color ink is relatively large. In addition, it is more desirable that the sum of the unit areas where the second color ink and the first color ink applied in this order are relatively wide, is greater than the sum of the unit areas where the first color ink and the second color ink applied in this order are relatively wide.

Further, in the above exemplary embodiments, the order of discharge of inks are controlled using mask patterns. Alternatively, the present invention is sufficiently applicable so long as a method for performing recording with respect to each pixel is provided. In that case, the method is not limited to mask patterns. It is possible to obtain the effects of the present invention also in, for example, the configuration in which it is sequentially determined which recording scan is to be performed to record each pixel with respect to each row of pixels extending in the X-direction, thereby controlling the order of discharge of inks.

In the recording apparatus according to an example of the present invention, it is possible to reduce the granular quality, while decreasing the deterioration of the image clarity resulting from the penetrating property of an ink applied on top that sinks into an ink applied underneath. Thus, it is possible to obtain an image having an excellent image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-086144 filed Apr. 16, 2013, which is hereby incorporated by reference herein in its entirety.

What is claimed is:

1. A recording apparatus comprising:

a recording head configured to discharge a plurality of inks including a first color ink containing a pigment and a second color ink which contains a pigment and is different from the first color ink; and a recording control unit configured to, while scanning with the recording head at multiple times in a scan direction relative to a unit area in a recording medium, discharge the plurality of inks from the recording head to the unit area, thereby recording an image, wherein a dot diameter of the first color ink formed by discharging a predetermined amount of the first color ink onto a surface of the second color ink fixed on the recording medium is smaller than a dot diameter of the second color ink formed by discharging the predetermined amount of the second color ink onto a surface of the first color ink fixed on the recording medium, and wherein the recording head discharges the plurality of inks such that, with respect to pixels forming the image in the unit area, the pixels in the unit area include more pixels formed by discharging the first color ink by a scan of the recording head which is performed after a scan of the recording head with discharging the second color ink than pixels formed by discharging the second color ink by a scan of the recording head which is performed after a scan of the recording head with discharging the first color ink.

2. The recording apparatus according to claim 1, wherein the recording head discharges the plurality of inks such that all the pixels in the unit area are formed by discharging the first color ink by a scan of the recording head which is performed after a scan of the recording head with discharging the second color ink.

3. The recording apparatus according to claim 1, wherein the plurality of inks further include a third color ink which contains a pigment and is different from the first and second color inks, wherein the dot diameter of the second color ink formed by discharging the predetermined amount of the second color ink onto a surface of the third color ink fixed on the recording medium is smaller than a dot diameter of the third color ink formed by discharging the predetermined amount of the third color ink onto the surface of the second color ink fixed on the recording medium, and wherein the recording head discharges the plurality of inks such that, with respect to pixels, the pixels in the unit area include more pixels formed by discharging the second color ink by a scan of the recording head which is performed after a scan of the recording head with discharging the third color ink than pixels formed by discharging the third color ink by a scan of the recording head which is performed after a scan of the recording head with discharging the second color ink.

4. The recording apparatus according to claim 1, wherein between scans of the recording head, the recording medium is conveyed from an upstream to a downstream side in a conveying direction which intersects the scan direction, wherein the recording head includes a first discharge port array in which a plurality of discharge ports for discharging the first color ink are arranged in a direction intersecting the scan direction, and a second discharge port array in which a plurality of discharge ports for discharging the second color ink are arranged in a direction intersecting the scan direction, and wherein the second discharge port array is placed at a position different from a position of the first discharge port array with respect to the scan direction, and at a position shifted upstream from the position of the first discharge port along the conveying direction.

5. The recording apparatus according to claim 1, wherein between scans of the recording head, the recording medium is conveyed from an upstream to a downstream side in a conveying direction which intersects the scan direction, wherein the recording head includes a first discharge port array in which a plurality of discharge ports for discharging the first color ink are arranged in a direction intersecting the scan direction, and a second discharge port array in which a plurality of discharge ports for discharging the second color ink are arranged in a direction intersecting the scan direction, wherein the first and second discharge port arrays are placed at positions different from each other with respect to the scan direction and corresponding to the conveying direction, and wherein a predetermined number of discharge ports arranged in an upstream end portion of the first discharge port array and a predetermined number of discharge ports arranged in a downstream end portion of the second discharge port array are not used for recording.

6. The recording apparatus according to claim 1, wherein the recording head discharges the plurality of inks based on recording data which determines a discharge of ink, the recording data corresponding to each pixel on the recording medium, and wherein the recording data is generated using a mask pattern in which recording permission pixels and recording non-permission pixels are arranged.

7. The recording apparatus according to claim 6, wherein a mask pattern to be applied to a predetermined number of discharge ports of the second discharge port array in a predetermined scan of the recording head has the same shape as a mask pattern to be applied to a predetermined number of discharge ports of the first discharge port array in a scan of the recording head after the predetermined scan.

8. The recording apparatus according to claim 1, wherein pixels formed by discharging the second color ink and the first color ink in this order when a total recording duty of the plurality of inks is a first value, are more than pixels formed by discharging the second color ink and the first color ink in this order when the total recording duty of the plurality of inks is a second value which is smaller than the first value.

9. The recording apparatus according to claim 1, wherein the pigment contained in the second color ink has a larger average particle diameter with respect to primary particles than the pigment contained in the first color ink.

10. The recording apparatus according to claim 1, wherein each of the first and second color inks contains a first resin for dispersing the pigment and a second resin different from the first resin, and wherein a ratio of an amount of the pigment contained in the second color ink to an amount of the second resin contained in the second color ink is higher than a ratio of an amount of the pigment contained in the first color ink to an amount of the second resin contained in the first color ink.

11. The recording apparatus according to claim 1, wherein an absorbing layer for absorbing ink is formed on a surface of the recording medium.

12. A recording method for scanning with a recording head configured to discharge a plurality of inks including a first color ink containing a pigment and a second color ink which contains a pigment and is different from the first color ink, by scanning with a recording head at multiple times in a scan direction relative to a unit area in a recording medium, and discharging the plurality of inks from the recording head to the unit area, thereby recording an image, wherein a dot diameter of the first color ink formed by discharging a predetermined amount of the first color ink onto a surface of the second color ink fixed on the recording medium is smaller than a dot diameter of the second color ink formed by discharging the predetermined amount of the second color ink onto a surface of the first color ink fixed on the recording medium, and wherein the recording head discharges the plurality of inks such that, with respect to pixels forming the image in the unit area, the pixels in the unit area include more pixels formed by discharging the first color ink by a scan of the recording head which is performed after a scan of the recording head with discharging the second color ink than pixels formed by discharging the second color ink by a scan of the recording head which is performed after a scan of the recording head with discharging the first color ink.

13. The recording method according to claim 12, wherein the recording head discharges the plurality of inks such that all the pixels in the unit area are formed by discharging the first color ink by a scan of the recording head which is performed after a scan of the recording head with discharging the second color ink.

14. The recording method according to claim 12, wherein the plurality of inks further includes a third color ink which contains a pigment and is different from the first and second color inks, wherein the dot diameter of the second color ink formed by discharging the predetermined amount of the second color ink onto a surface of the third color ink fixed on the recording medium is smaller than a dot diameter of the third color ink formed by discharging the predetermined amount of the third color ink onto the surface of the second color ink fixed on the recording medium, and wherein the recording head discharges the plurality of inks such that, with respect to pixels forming an image in the unit area, the pixels in the unit area include more pixels formed by discharging the second color ink by a scan of the recording head which is performed after a scan of the recording head with discharging the third color ink than pixels formed by discharging the third color ink by a scan of the recording head which is performed after a scan of the recording head with discharging the second color ink.

15. The recording method according to claim 12, wherein the recording head discharges the plurality of inks based on recording data which determines a discharge of ink, the recording data corresponding to each pixel on the recording medium, and wherein the recording data is generated using a mask pattern in which recording permission pixels and recording non-permission pixels are arranged.

16. A recording apparatus comprising:

a recording head configured to discharge a plurality of inks including a first color ink containing a pigment, a second color ink which contains a pigment and is different from the first color ink, and a third color ink which contains a pigment and is different from the first and second color inks; and a recording control unit configured to, while scanning with the recording head in a scan direction relative to a recording medium, discharge the plurality of inks from the recording head to a unit area in the recording medium, thereby recording an image, wherein (i) a dot diameter of the first color ink formed by discharging a predetermined amount of the first color ink onto a surface of the second color ink fixed on the recording medium is smaller than a dot diameter of the second color ink formed by discharging the predetermined amount of the second color ink onto a surface of the first color ink fixed on the recording medium, and (ii) a dot diameter of the second color ink formed by discharging the predetermined amount of the second color ink onto a surface of the third color ink fixed on the recording medium is smaller than a dot diameter of the third color ink formed by discharging the predetermined amount of the third color ink onto the surface of the second color ink fixed on the recording medium, and wherein the recording head discharges the plurality of inks such that, with respect to pixels forming the image in the unit area, the pixels in the unit area include more pixels formed by discharging the third color ink, the second color ink and the first color ink in this order than pixels formed by discharging the first color ink, the second color ink and the third color ink in an order other than the order of the third color ink, the second color ink and the first color ink.

17. The recording apparatus according to claim 16, wherein the recording head discharges the plurality of inks such that, with respect to pixels forming an image in the unit area, the pixels in the unit area include (i) more pixels formed by discharging the first color ink by a scan of the recording head which is performed after a scan of the recording head with discharging the second color ink than pixels formed by discharging the second color ink by a scan of the recording head which is performed after a scan of the recording head with discharging the first color ink, and (ii) more pixels formed by discharging the second color ink by a scan of the recording head which is performed after a scan of the recording head with discharging the third color ink than pixels formed by discharging the third color ink by a scan of the recording head which is performed after a scan of the recording head with discharging the second color ink.

18. A recording apparatus comprising:

a recording head configured to discharge a plurality of inks including (i) a first color ink containing a pigment, a first resin for dispersing the pigment, and a second resin different from the first resin, and (ii) a second color ink which contains a pigment, the first resin, and the second resin, the second color ink being different from the first color ink; and a recording control unit configured to, while scanning with the recording head in a scan direction relative to a recording medium, discharge the plurality of inks from the recording head to a unit area in the recording medium, thereby recording an image, wherein a dot diameter of the first color ink formed by discharging a predetermined amount of the first color ink onto a surface of the second color ink fixed on the recording medium is smaller than a dot diameter of the second color ink formed by discharging the predetermined amount of the second color ink onto a surface of the first color ink fixed on the recording medium, wherein a ratio of an amount of the pigment contained in the second color ink to an amount of the second resin contained in the second color ink is higher than a ratio of an amount of the pigment contained in the first color ink to an amount of the second resin contained in the first color ink, and wherein the recording head discharges the plurality of inks such that, with respect to pixels forming an image in the unit area, the pixels in the unit area include more pixels formed by discharging the second color ink and the first color ink in this order than pixels formed by discharging the first color ink and the second color ink in this order.

19. The recording apparatus according to claim 18, wherein the recording head discharges the plurality of inks such that, with respect to pixels forming the image in the unit area, the pixels in the unit area include more pixels formed by discharging the first color ink by a scan of the recording head which is performed after a scan of the recording head with discharging the second color ink than pixels formed by discharging the second color ink by a scan of the recording head which is performed after a scan of the recording head with discharging the first color ink.

* * * * *